United States Patent [19]

Wood et al.

[11] 4,325,161

[45] Apr. 20, 1982

[54] WORKPIECE CLEANSING APPARATUS

[75] Inventors: Trevor E. Wood, Leamington Spa; Gene R. Cooper, Coventry; Raymond Kemp, Birmingham, all of England

[73] Assignee: Otto Durr, Warwick, England

[21] Appl. No.: 183,407

[22] Filed: Sep. 3, 1980

[30] Foreign Application Priority Data

Sep. 7, 1979 [GB] United Kingdom ..... 31221/79

[51] Int. Cl.[3] ..... A47L 5/38

[52] U.S. Cl. ..... 15/304; 15/316 A; 15/316 R; 134/116; 134/166 R

[58] Field of Search ..... 15/304, 316 R, 316 A; 134/103, 116, 166, 169

[56] References Cited

U.S. PATENT DOCUMENTS

| | | | |
|---|---|---|---|
| 2,038,134 | 4/1936 | Schiffner | 15/304 |
| 2,302,078 | 11/1942 | Wadman | 15/304 X |
| 2,361,660 | 10/1944 | Sneddon | 15/304 |
| 2,531,009 | 11/1950 | Stuart et al. | 15/304 |
| 2,765,761 | 10/1956 | Truran | 15/316 R X |
| 2,968,584 | 1/1961 | Dickey | 15/304 X |
| 3,765,050 | 10/1973 | Van Allman et al. | 15/304 |

*Primary Examiner*—Chris K. Moore

*Attorney, Agent, or Firm*—Cushman, Darby & Cushman

[57] ABSTRACT

A workpiece cleansing apparatus has a walking beam conveyor for transporting a camshaft to be cleaned to a first work station consisting of row of cradles which support the camshaft in such a way that oil ports therein are not blocked. Pressurized air is fed through an oil channel in the camshaft and passes through the oil ports to the exterior to remove moisture therefrom. The camshaft is then transported to a second work station where it is supported by cradles which mate with cradles so encircling the oil ports. The pressurized air is fed to the cradles and passes through the oil ports to the oil channel and thence to atmosphere.

10 Claims, 6 Drawing Figures

WORKPIECE CLEANSING APPARATUS

This invention relates to workpiece cleansing apparatus.

According to the present invention there is provided a workpiece cleansing apparatus comprising: conveyor means for transporting to a first work station a workpiece having an interior channel therein and at least one passageway extending from the interior channel to the exterior; first support means for supporting said workpiece in said first work station in such a manner that the passageway or passageways are not blocked by the first support means; first fluid flow means for causing pressurised fluid to flow through the or each said passageway in one direction; second support means for supporting the workpiece in a second work station to which the workpiece is transported from the first work station by said conveyor means, the second support means being such that said passageway or passageways in the workpiece are not blocked thereby; and second fluid flow means for causing pressurised fluid to flow through the or each passageway in the opposite direction.

Preferably said support means comprises at least one cradle, the or each of which has a groove therein adapted to communicate with the or at least one of the passageways in the workpiece.

Said first fluid flow means may comprise a first member connectable to a source of pressurised fluid to supply pressurised fluid to one end of the interior channel of the workpiece and a second member for closing the other end of the interior channel of the workpiece, the first and second members being so arranged as to cause pressurised fluid to flow from the interior channel through the or each passageway.

In the preferred embodiment said second support means comprises at least one pair of cradles which, when in a closed position, enclose the workpiece, each cradle having a groove therein, the grooves of the or each pair of cradles being arranged to communicate with the or at least one of the passageways in the workpiece, the second fluid flow means, in operation, supplying pressurised fluid to said grooves to cause fluid to flow through the passageways to the interior channel of the workpiece. The apparatus may include moving means for moving the cradles of the or each pair of cradles to an open position in which the workpiece can be inserted therebetween and for moving the cradles of the or each pair of cradles to the closed position. Thus the moving means may comprise a bed on which one cradle of the or each pair of cradles is mounted.

The said bed may include a plenum chamber for supplying pressurised fluid to the groove in said one cradle of the or each pair of cradles.

Preferably the other cradle of the or each pair of cradles is connected to fixed structure.

In the preferred embodiment the apparatus includes third support means for supporting said workpiece in a third work station to which the workpiece is transported from the second work station by said conveyor means, said third support means supporting the workpiece in such a manner that the passageway or passageways are not blocked thereby, and third fluid flow means for causing pressurised fluid to flow from the interior channel through the or each said passageway to the exterior.

The apparatus may further include fourth support means for supporting the workpiece in a fourth work station to which the workpiece is transported from the third work station by said conveyor means, said fourth support means supporting the workpiece in such a manner that the passageway or passageways are not blocked thereby, and fourth fluid flow means for causing pressurised fluid to flow through the or each said passageways in the workpiece to the interior channel.

The invention is illustrated, merely by way of example, in the accompanying drawings, in which.

Figure 1:
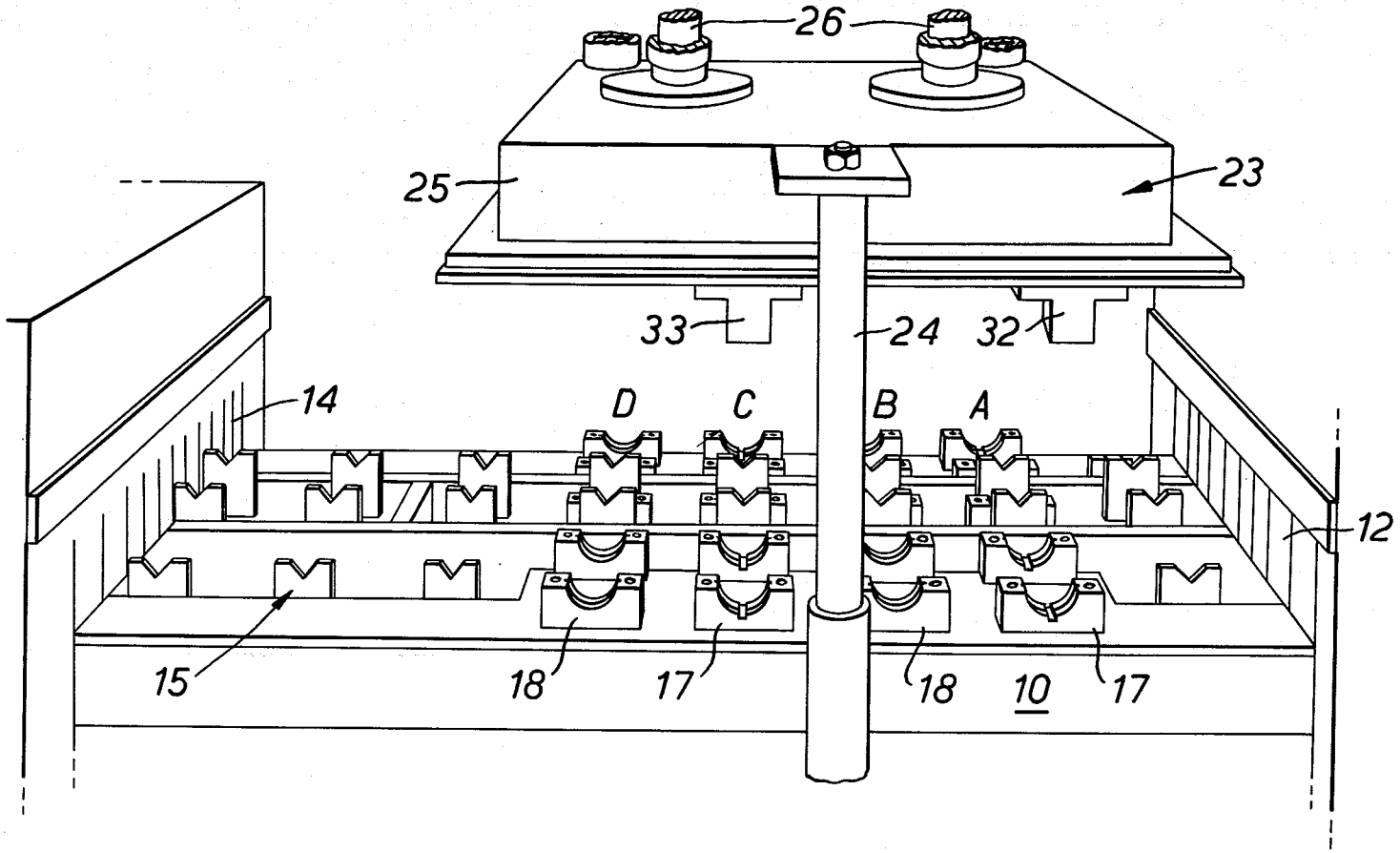
FIG. 1 is a schematic view of a workpiece cleaninsing apparatus according to the present invention.

In the following description terms such as "upper", "lower" etc. refer to the directions as seen in the drawings.

Referring first to FIG. 1, a workpiece cleansing apparatus according to the present invention comprises a fixed lower bed 10 having a flexible inlet door 12 and a flexible outlet door 14. Workpieces are transported through the cleansing apparatus from the inlet door 12 to the outlet door 14 by means of a walking beam conveyor 15.

Figure 2:
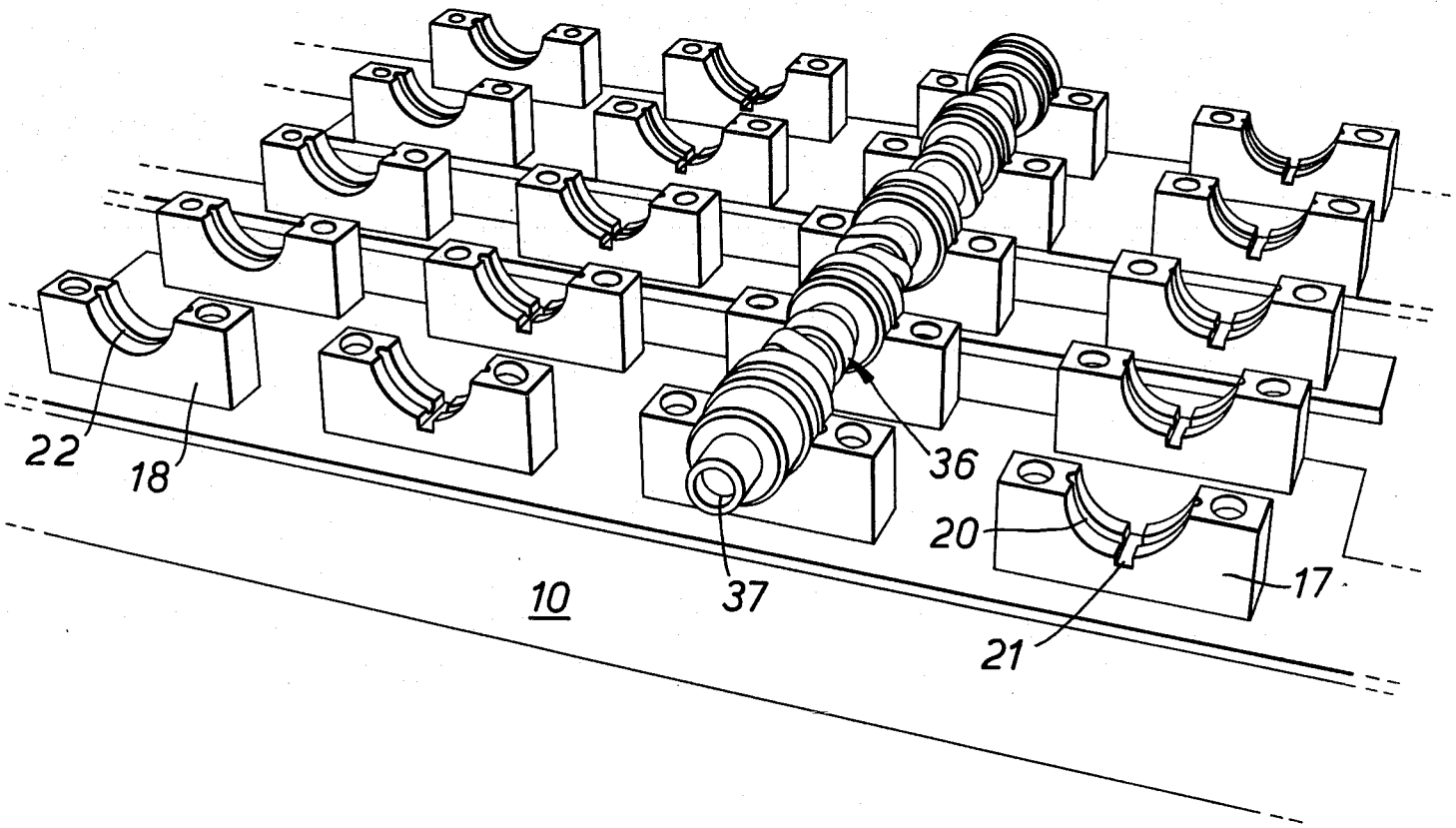
FIG. 2 is a perspective view of a lower bed of the apparatus shown in FIG. 1.

Rigidly mounted on the lower bed 10 by means of bolts 16 (FIG. 4) are four rows A, B, C, D of cradles, each row defining a work station. Cradles 17 in rows A and C are identical and cradles 18 in rows B and D are identical. Each of the cradles 17 is a half-cylinder with an arcuate internal peripheral groove 20 (best shown in FIG. 2) and an axially extending slot 21. Each of the cradles 18 is also a half-cylinder with an arcuate internal peripheral groove 22.

The cleansing apparatus has an upper bed 23 which is moveable towards and away from the lower bed 10 by means of pneumatic or hydraulic jacks 24 only one of which is shown in the drawings. The upper bed 23 comprises a plenum chamber 25 connected to a source of pressurised air (not shown), for example, a centrifugal fan-type blower, by means of flexible hoses 26 which are only shown in part.

Figure 3:
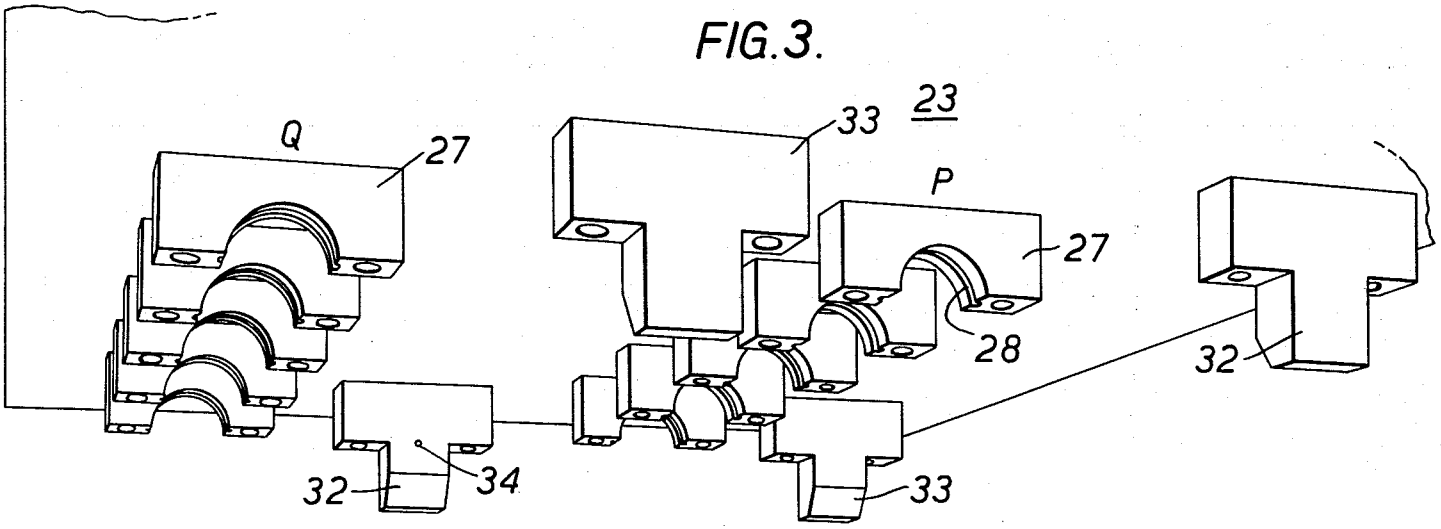
FIG. 3 is a perspective view of an upper bed of the apparatus of FIG. 1.
Figure 4:
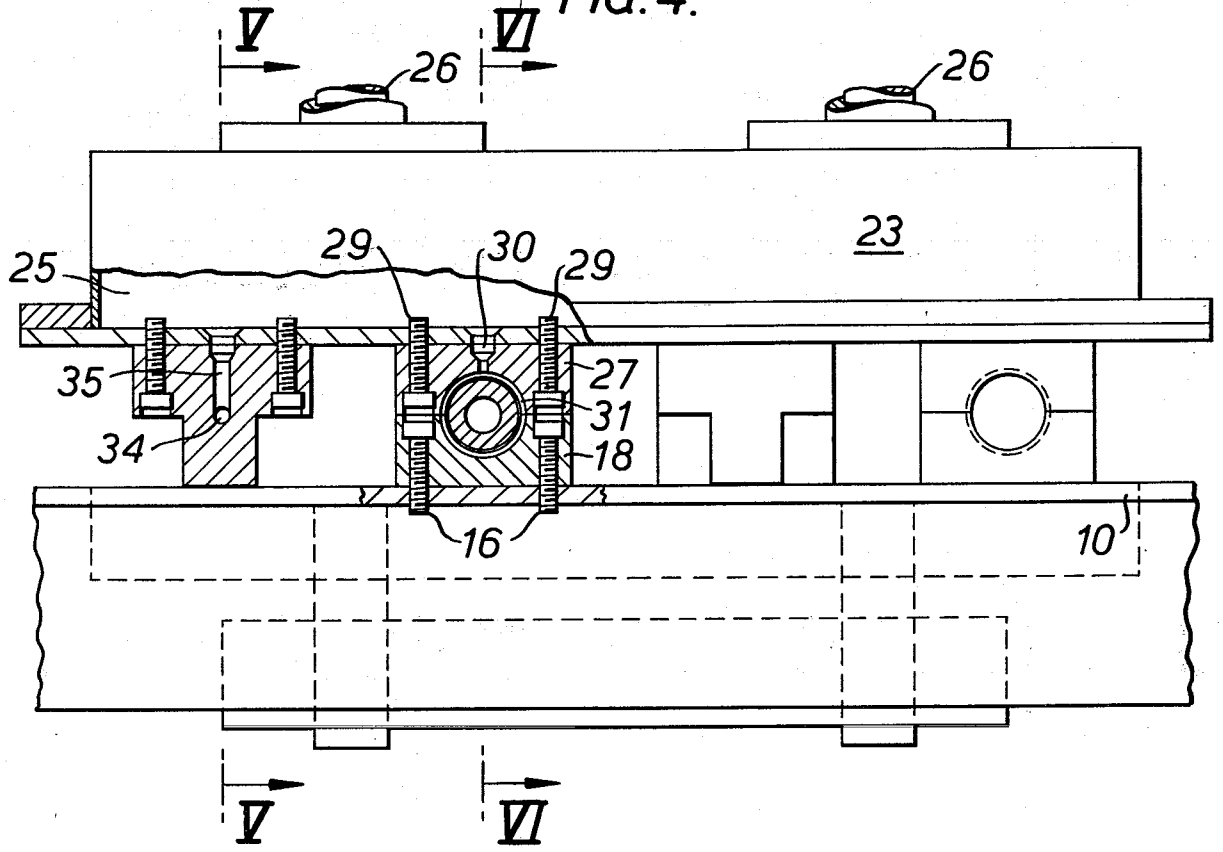
FIG. 4 is a longitudinal sectional view of part of the apparatus of FIG. 1.
Figure 5:
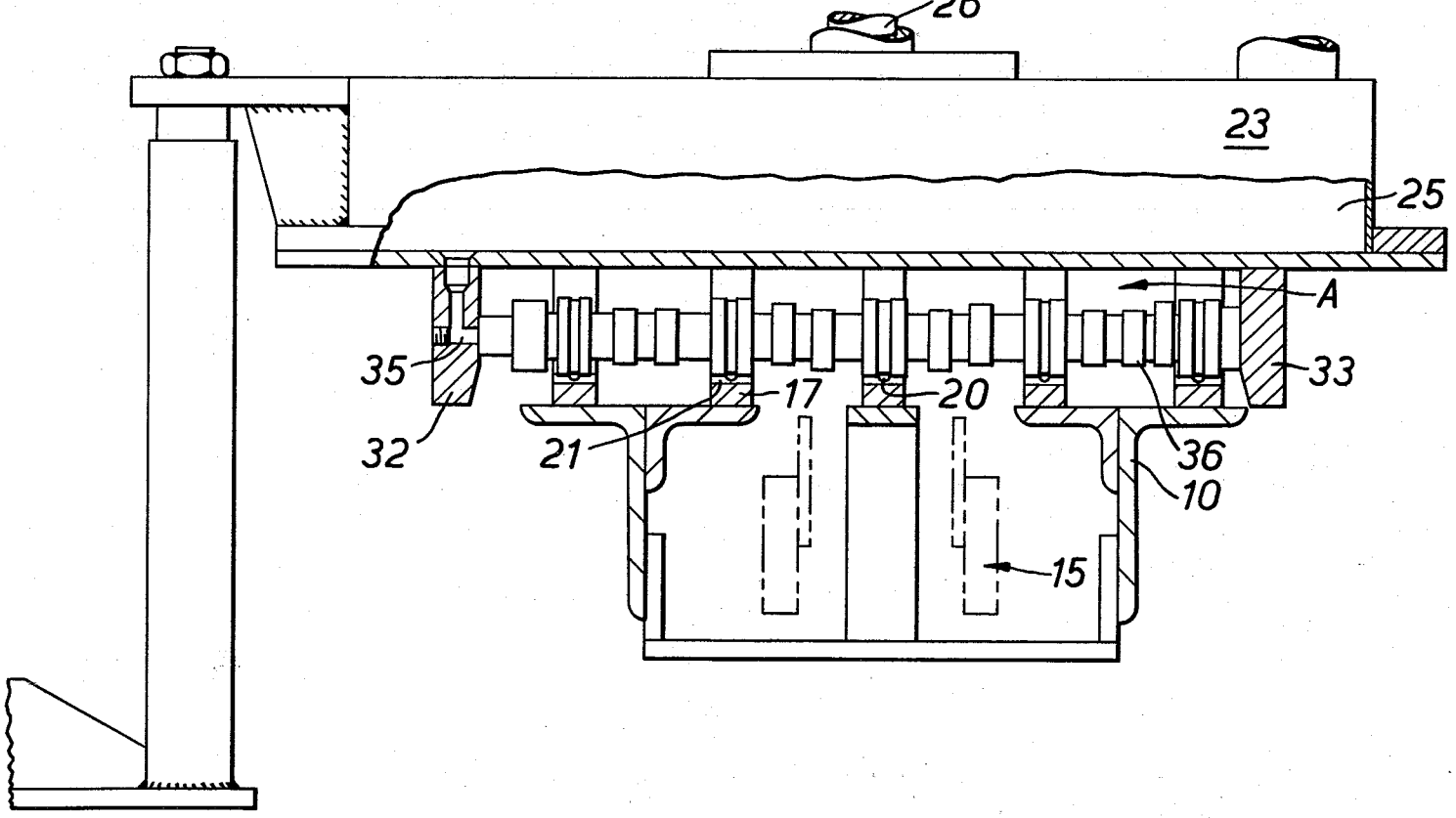
FIG. 5 is a section taken on the line V—V of FIG. 4.

As best seen in FIG. 3, the under surface of the upper bed 23, that is the surface which faces the lower bed 10, has fixed thereto two rows P, Q of cradles 27 which are identical to one another. Each of the cradles 27 is a half-cylinder with an arcuate internal peripheral groove 28 and is mounted on the upper bed by means of bolts 29 (FIG. 4). A passageway 30 extends from each groove 28 to communicate with the plenum chamber 25. The cradles 27 of the rows P, Q mate with respective cradles 18 in the corresponding rows B, D on the lower bed 10, to define a cylindrical aperture 31 (FIG. 4) when the upper bed is moved to a closed position by the jacks 24. As shown in FIG. 3, the under surface of the upper bed 23 carries two pairs of end plates 32, 33. Each end plate 32 has an aperture 34 therein which communicates via a passageway 35 with the plenum chamber 25. Each pair of end plates 32, 33 is axially aligned with a respective row A, C of cradles 17 when the upper bed is in the closed position.

The operation of the cleansing apparatus illustrated in the drawings will now be described with reference to the cleansing, in this case drying, of a camshaft 36 (FIG. 2) which has an axial oil channel 37 therethrough and radially extending oil ports (not shown) communicating with the oil channel 37. Initially the upper and lower beds are in an open position as shown in FIG. 1 and a camshaft, which for example has just been washed and so has moisture on its surfaces, is conveyed into the cleansing apparatus through the inlet door 12 by the walking beam conveyor 15 until it is supported on the row A of cradles 17. The cradles 17 are so disposed on the lower bed 10 that each oil port in the camshaft 36 communicates either directly to atmosphere or to atmosphere via the groove 20 and the slot 21 in the adjacent cradles 17 and so is not blocked by the cradle itself. With the camshaft located on the row A of cradles 17 the upper bed is moved to the closed position where it is adjacent the lower bed 10 as shown in FIG. 4, upon actuation of the jacks 24. In the closed position the pair of end plates 32, 33 on the upper bed 23 and corresponding to the row A of cradles 17 mate and seal with the open ends of the oil channel 37 of the camshaft 36. Pressurised air enters one end of the oil channel 37 in the camshaft from the plenum chamber 25 via the passageway 35 in the end plate 32. Since the pressurised air cannot leave the oil channel by way of the other end thereof because this is blocked by the end plate 33, it passes through the oil ports in the camshaft removing moisture from them and from the oil channel as it does so. It will be appreciated that none of the oil ports in the camshaft are blocked during this operation because each oil port is in communication with atmosphere either directly or by way of the grooves 20 in the cradles 17.

Figure 6:
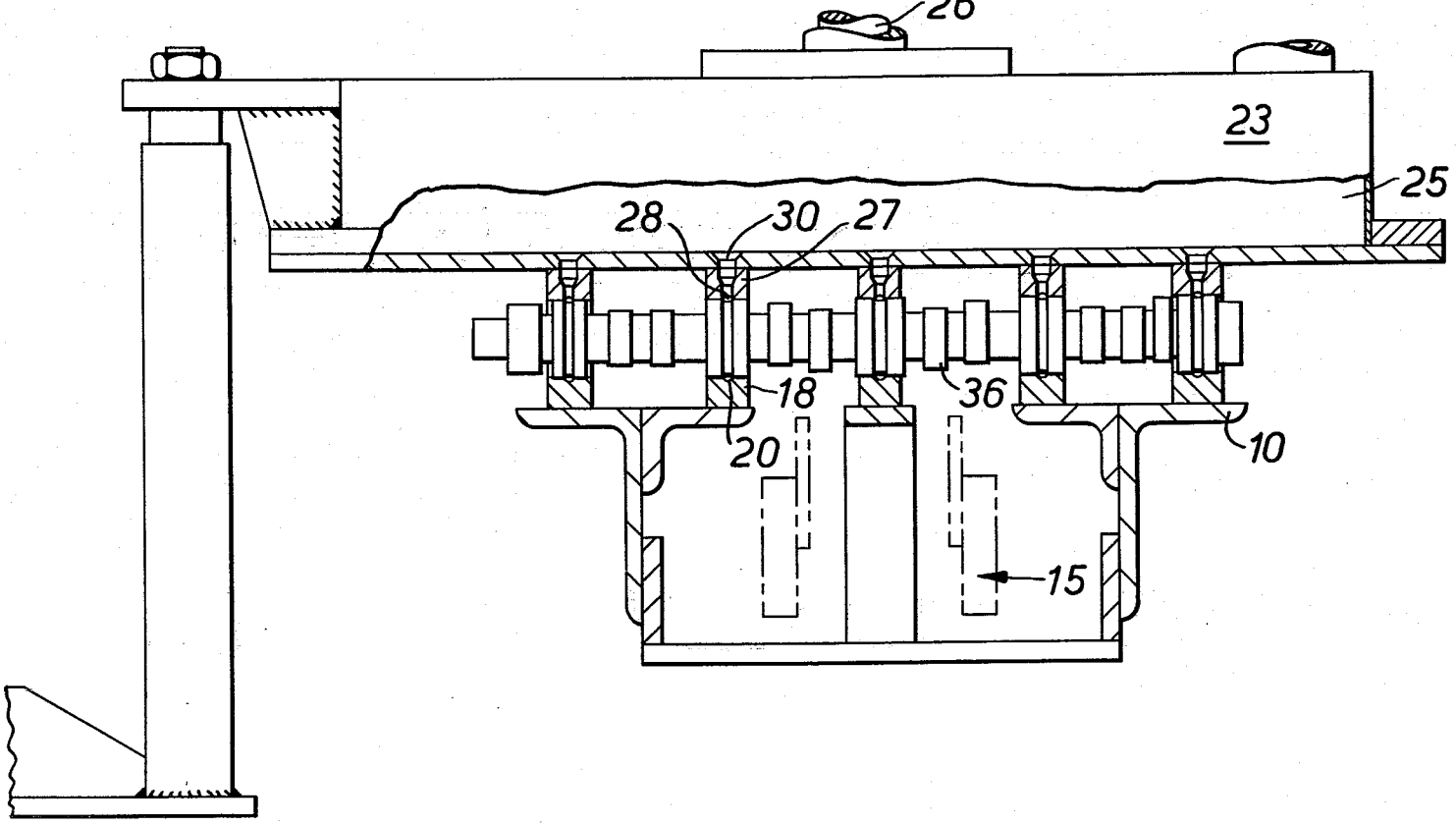
FIG. 6 is a section taken on the line VI—VI of FIG. 4.

After a predetermined time determined by control apparatus (not shown) the jacks 24 are actuated to move the upper bed to the open position. The walking beam conveyor then transfers the camshaft from row A of cradles 17 to row B of cradles 18 and the upper bed is moved to the closed position by means of the jacks 24. As shown most clearly in FIGS. 4 and 6 each pair of corresponding cradles 18, 27 mate and closely encircle the camshaft. Each oil port in the camshaft communicates either with the groove 22 in the adjacent cradle 18 or the groove 28 in the adjacent cradle 27. Pressurised air from the plenum chamber 25 passes through the passageways 30 in the cradles 27 and so into the grooves 28 thereof and the grooves 20 in the cradles 18. From the grooves 20, 28 the pressurised air passes through the oil ports in the camshaft to the oil channel 37 and exits to atmosphere through the ends of the oil channel neither of which are blocked.

After a predetermined time again determined by the control apparatus the jacks 24 move the upper bed to the open position and the walking beam conveyor 15 transfers the camshaft to row C of cradles 17. The upper bed is moved to the closed position by the jacks 24 and the operation described above, when the camshaft was located on row A of cradles 17 is repeated the only difference being that the pressurised air enters the oil channel 37 from the opposite end.

After a further predetermined time determined by the control apparatus the jacks 24 move the upper bed to the open position and the walking beam conveyor 15 transfers the camshaft to row D of cradles 18. The upper bed is moved to the closed position and the operation described above when the camshaft was located on row B of cradles 18 is repeated.

The upper bed 23 is then moved to the open position by the jacks and the camshaft transported through the outlet door 14 by the walking beam conveyor.

From the above it will be appreciated that on row A of cradles 17 pressurised air flows from one end of the oil channel 37 of the camshaft to the other and from the interior of the camshaft to the exterior through the oil ports, on row B of cradles 18 the pressurised air flows from the exterior of the camshaft to the oil channel through the oil ports and thence to atmosphere, on row C of cradles 17 the pressurised air flows from said other end of the oil channel to said one end and to the exterior through the oil ports and on row D of cradles 17 the pressurised air flows from the exterior of the camshaft to the oil channel through the oil ports and thence to atmosphere. Thus all or substantially all moisture in the oil ports and the oil channel 37 will have been removed by the time the camshaft has been transported to the outlet door 14 of the cleansing apparatus.

The cleansing apparatus has been described in relation to the cleansing of camshafts but it will be appreciated that it may be modified to cleanse other workpieces which have an exterior channel extending all or part way therethrough and at least one passageway extending from the interior channel to the exterior. A cleansing apparatus according to the present invention may also be used to cleanse a workpiece with at least one open passageway therethrough, such as, for example, a crankshaft. A cleansing apparatus according to the present invention may form part of a machine where the workpiece is subjected to other operations prior and or subsequent to the cleansing operation by the cleansing apparatus. Thus a washing and/or degreasing and/or drying device or devices may be provided upstream and/or downstream of the cleansing apparatus.

The term "cleansing apparatus" is used herein in its widest sense and covers apparatus which not only removes moisture from workpieces but also covers apparatus which, for example, removes swarf, dust and other detritus and/or grease from a workpiece. In such a case the cleansing apparatus would use a cleaning solution, for example, a water/alkali solution under pressure instead of pressurised air.

What is claimed is:

1. A workpiece apparatus comprising:

conveyor means for transporting to a first work station a workpiece having an interior channel therein and at least one passageway extending from the interior channel to the exterior;

first support means for supporting said workpiece in said first work station in such a manner that said at least one passageway is not blocked by the first support means;

first fluid flow means for causing pressurised fluid to flow through said at least one passageway in one direction;

second support means for supporting the workpiece in a second work station to which the workpiece is transported from the first work station by said conveyor means, the second support means being such that said at least one passageway in the workpiece is not blocked thereby; and second fluid flow means for causing pressurised fluid to flow through said at least one passageway in the opposite direction.

2. An apparatus as claimed in claim 1 in which said first support means comprises at least one cradle having a groove therein adapted to communicate with said at least one passageway in the workpiece.

3. An apparatus as claimed in claim 1 in which said first fluid flow means comprises a first member connectable to a source of pressurised fluid to supply pressurised fluid to one end of the interior channel of the workpiece and a second member for closing the other end of the interior channel of the workpiece, the first and second members being so arranged as to cause pressurised fluid to flow from the interior channel through said at least one passageway.

4. An apparatus as claimed in claim 1 in which said second support means comprises at least one pair of cradles which, when in a closed position, enclose the workpiece, each cradle having a groove therein, the grooves of said at least one pair of cradles being arranged to communicate with said at least one passageway in the workpiece, the second fluid flow means, in operation, supplying pressurised fluid to said grooves to cause fluid to flow through said at least one passageway to the interior channel of the workpiece.

5. An apparatus as claimed in claim 4 including moving means for moving the cradles of said at least one pair of cradles to an open position in which the workpiece can be inserted therebetween and for moving the cradles of said at least one pair of cradles to the closed position.

6. An apparatus as claimed in claim 5 in which the moving means comprises a bed on which one cradle of said at least one pair of cradles is mounted.

7. An apparatus as claimed in claim 6 in which the said bed includes a plenum chamber for supplying pressurised fluid to the groove in said one cradle of said at least one pair of cradles.

8. An apparatus as claimed in claim 6 in which the other cradle of said at least one pair of cradles is connected to fixed structure.

9. An apparatus as claimed in claim 1 including third support means for supporting said workpiece in a third work station to which the workpiece is transported from the second work station by said conveyor means, said third support means supporting the workpiece in such a manner that said at least one passageway is not blocked thereby, and third fluid flow means for causing pressurised fluid to flow from the interior channel through said at least one passageway to the exterior.

10. An apparatus as claimed in claim 9 including fourth support means for supporting the workpiece in a fourth work station to which the workpiece is transported from the third work station by said conveyor means, said fourth support means supporting the workpiece in such a manner that said at least one passageway is not blocked thereby, and fourth fluid flow means for causing pressurised fluid to flow through said at least one passageway in the workpiece to the interior channel.

* * * * *